United States Patent [19]

Posciri

[11] 3,967,854

[45] July 6, 1976

[54] ENDLESS BUCKET TYPE EXCAVATOR

[76] Inventor: Charles L. Posciri, S.R. Box L1620 Clark R., Palmer, Alaska 99645

[22] Filed: Nov. 7, 1974

[21] Appl. No.: 521,583

[52] U.S. Cl. ..... 299/40; 37/94; 37/189; 175/331; 175/338; 175/361; 175/372; 299/25; 299/86; 299/89

[51] Int. Cl.[2] ..... E21C 25/10; E21C 27/30

[58] Field of Search ..... 299/40, 24, 25, 39, 299/67, 68, 86, 89, 53; 166/DIG. 1; 37/91, 94, 96, 97, 189; 137/18 P

[56] References Cited

UNITED STATES PATENTS

| | | | |
|---|---|---|---|
| 3,037,307 | 6/1962 | Ciddo et al. | 37/97 |
| 3,139,148 | 6/1964 | Robbins | 299/86 X |
| 3,601,207 | 8/1971 | Coski | 299/86 X |
| 3,610,691 | 10/1971 | Perote et al. | 299/25 |
| 3,639,005 | 2/1972 | Holm | 299/86 |
| 3,680,919 | 8/1972 | Rear et al. | 299/39 |
| 3,736,028 | 5/1973 | Davis | 299/25 |
| 3,773,386 | 11/1973 | Soderlund | 299/40 |
| 3,863,988 | 2/1975 | Bartels | 299/25 |

*Primary Examiner*—Ernest R. Purser
*Assistant Examiner*—William F. Pate, III
*Attorney, Agent, or Firm*—Graybeal, Barnard, Uhlir & Hughes

[57] ABSTRACT

Each bucket includes a ground engaging leading portion characterized by roller cutter means alternating with scoop teeth transversely across the bucket. The scoop teeth on alternate buckets follow the path of roller cutter means on intermediate buckets. The scoop teeth on intermediate buckets follow the path of roller cutter means on alternate buckets.

8 Claims, 6 Drawing Figures

ENDLESS BUCKET TYPE EXCAVATOR

RELATED APPLICATION

This application is a substitute for my prior U.S. application Ser. No. 441,555, filed on Feb. 11, 1974, and entitled Excavation Buckets, and now abandoned.

BACKGROUND OF THE INVENTION

1. Field of the Invention

The present invention relates to excavating machines. More particularly it relates to an improved bucket type excavator capable of excavating frozen ground, or other ground material of similar hardness.

2. Description of the Prior Art

Bucket type excavators are a well-known class of earth moving equipment. They are characterized generally by an endless chain of buckets supported for tangential entry into ground to be excavated. The Parsons Division of Koehring Company of Newton, Iowa, manufactures both wheel and boom styles of bucket type excavators. Further examples of known bucket type excavators are shown by U.S. Pat. Nos. 3,610,691; 3,663,063 and 3,680,919.

It is also generally known to use roller cutter elements either alone or in combination with drag bits, for cutting hard ground material. Examples of earth excavating machines using roller type cutting means are shown by U.S. Pat. Nos. 2,096,875; 2,244,537; 2,808,253; 3,049,823; 3,139,148; and 3,393,014.

SUMMARY OF THE INVENTION

This invention relates to a bucket type excavator comprising roller cutter means on the buckets for penetrating and fracturing or loosening hard ground material, and scoop teeth on the buckets for aiding pickup of the loosened ground material. Such excavator is especially adapted for use in excavating frozen ground such as perma-frost found in Alaska. However, it is not limited to this use but can also be employed for excavating other types of hard ground material which cannot be satisfactorily cut by the bucket lips or ripper teeth thereon.

According to the invention, an endless chain of buckets is supported for tangential entry into the ground to be excavated. Each bucket includes a transverse leading portion characterized by roller cutter means alternating with scoop teeth. The scoop teeth on alternate buckets follow the path of roller cutter means on intermediate buckets and the scoop teeth on intermediate buckets follow the path of roller cutter means on alternate buckets. The roller cutter means include radial teeth which are pressed into the hard ground during forward advancement of the excavator and forward movement of the buckets. The teeth fracture and loosen the ground material and then such loosened material is scooped up by the scoop teeth on the trailing bucket.

These and other features, advantages and characteristics of the excavating equipment of this invention will be apparent from the following detailed description of a typical and therefore non-limitive embodiment of the invention and from the accompanying illustrations.

DESCRIPTION OF THE ILLUSTRATED EMBODIMENT

Figure 1:
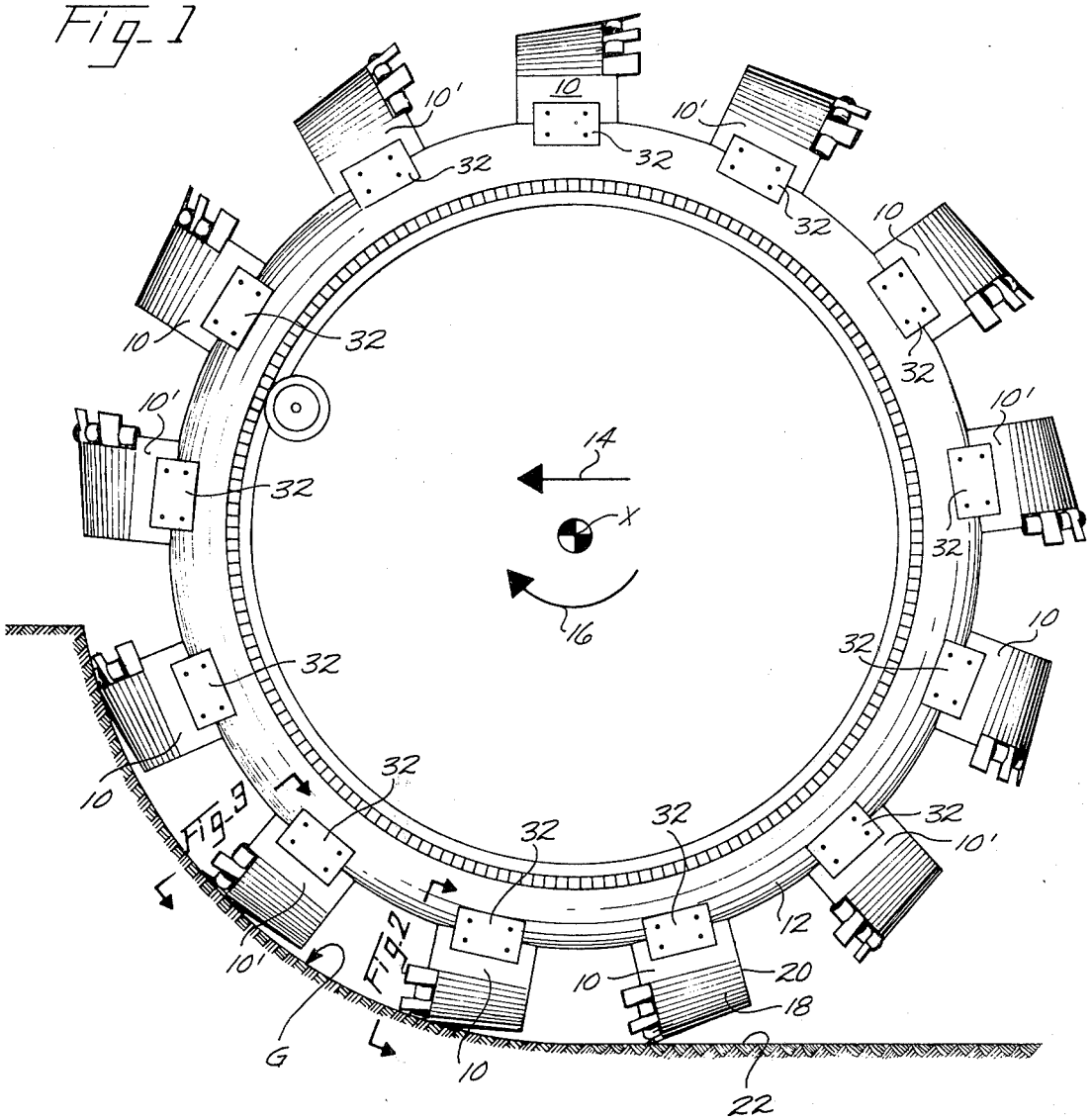
FIG. 1 is a side elevational view of a wheel type embodiment of the invention, such view including a curved arrow indicating the direction of rotation of the wheel and a straight arrow indicating the direction of advancement of the excavator.

Referring first to FIG. 1, a chain of buckets 10, 10' are mounted on the periphery of a wheel 12 which is in turn supported for rotation about the transverse axis X in a conventional manner, forwardly of a vehicular portion of the excavator (not shown). Arrow 14 indicates the direction of travel of the excavator and arrow 16 indicates the direction of rotation of wheel 12.

The buckets 10, 10' are mounted onto a peripheral frame portion of the wheel 12. Buckets 10, 10' open generally tangentially and are defined by closed side and rear end walls 18, 20.

As shown by FIG. 1, rotation and forward travel of wheel 12 move the buckets 10, 10' generally tangentially into the ground material G. The buckets 10, 10' enter and in effect plane off a layer of the ground G. Each bucket 10, 10' includes a transverse leading portion which cuts into the ground starting at the bottom or floor grade 22 and continuing throughout the upwardly arcuate path of the bucket 10, 10'. When each bucket 10, 10' moves free of the ground above the upper grade 24 it contains earth material which is ultimately dumped from the bucket 10, 10' onto a conventional conveyor means (not shown).

Figure 2:
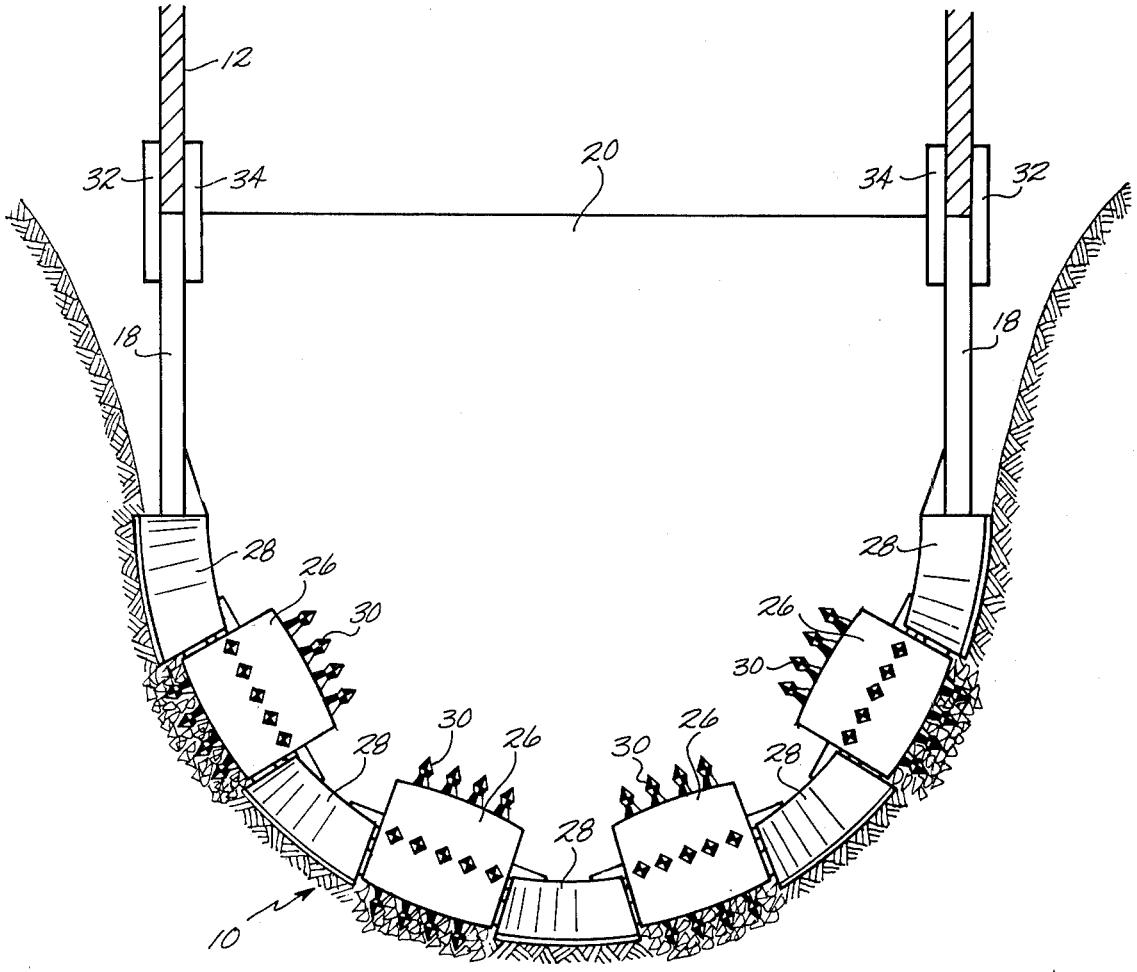
FIG. 2 is a fragmentary front elevational view looking toward the mouth of a first type of bucket on the wheel, showing the alternate spacing of roller cutter means and scoop teeth on the bucket, and also showing the manner in which the cutting teeth on the roller cutter means penetrate into the ground material.

According to the invention, the transverse leading portion of each bucket is characterized by roller cutter means 26 alternating with scoop teeth 28. The scoop teeth 28 on alternate buckets 10 follow in the path of the roller cutter means 26 on the intermediate buckets 10' and the scoop teeth 28 on the intermediate buckets 10' follow in the path of the roller cutter means 26 on the alternate buckets 10. The roller cutter means 26 include radially extending cutter teeth which penetrate into and dislodge the ground material as the wheel 12 turns. A group of cutter teeth 30 progressively enter hard ground as the roller supporting such teeth reaches the start of the ascent of the ground G. The teeth 30 penetrate into and fracture the hard ground. Further movement of wheel 12 causes a reverse rotation of the rollers 26 and a rearward movement of the teeth 30 through fractured ground material. The scoop teeth 28 on the immediately trailing bucket 10, 10' scoop up the loosened material and move it rearwardly into the inner space of the bucket 10, 10'. Referring now to FIGS. 2 and 3, in preferred form the bucket has a transversely arcuate shaped leading portion.

Figure 3:
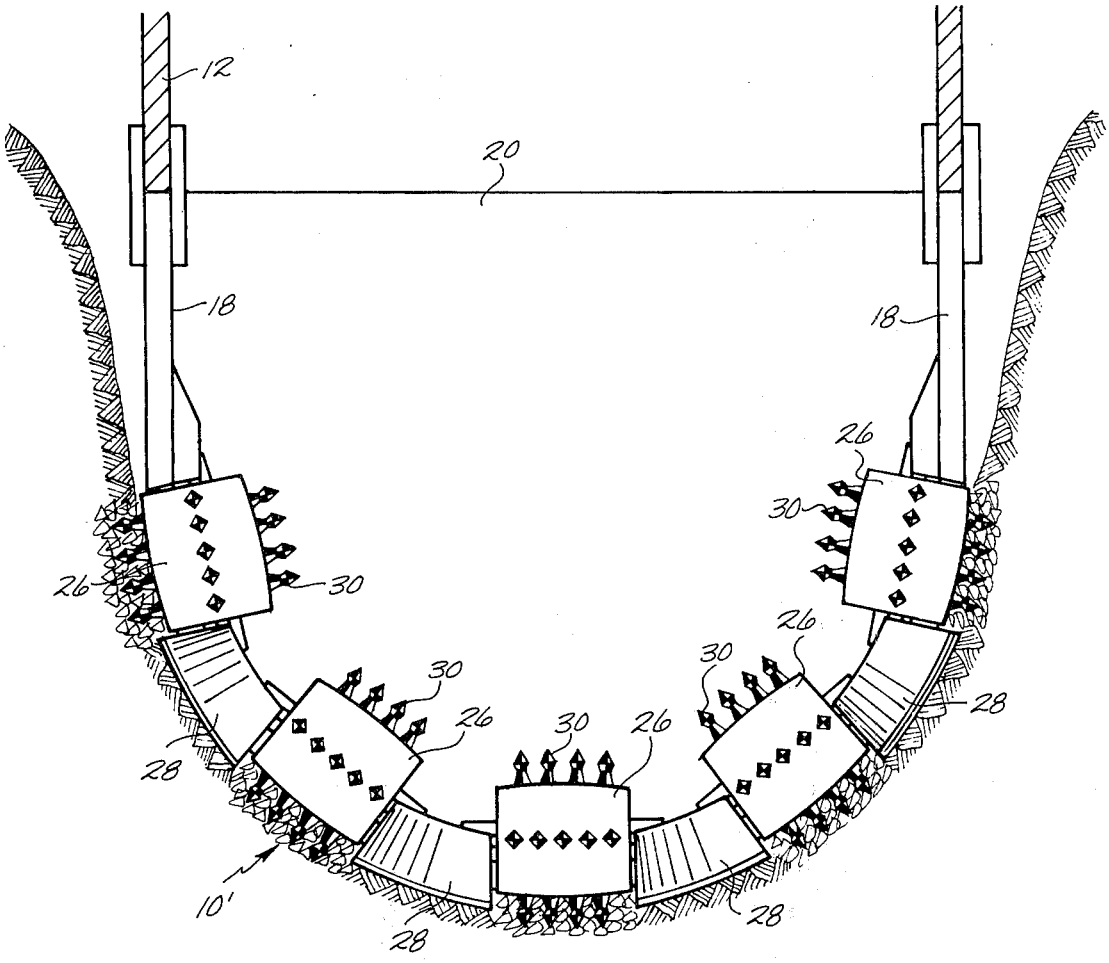
FIG. 3 is a view similar to FIG. 2, but looking toward a second type of bucket on the wheel, and showing the roller cutter means on such bucket in the position of the scoop teeth on the first type of bucket, and the scoop teeth on such bucket in the position of the roller cutter means on the first type of bucket.

As a comparison of FIGS. 1 – 3 will show, only about one-fourth of the buckets 10, 10′ are in contact with the ascending face of the ground G at any given time and only a fraction (e.g. about a fourth) of the teeth 30 of each roller 26 in contact with the ascending ground is actually penetrating the ground material at any given point of time. The force of the machine against the hard ground material is concentrated on these teeth 30.

In preferred form, the teeth 30 include a pyramid or cone shaped end portion, which may be constructed from a hardened material such as tungsten carbide, and a recessed shank portion which may be constructed from a softer material. The recesses provide expansion room for the dislodged ground material.

By way of typical and therefore non-limitive example, the individual buckets 10, 10′ may be secured to the peripheral frame of wheel 12 by means of inner and outer connector plates 32, 34. The plates 32, 34 may be bolted to the bucket side walls 18 and to the corresponding side portions of the wheel frame.

The buckets 10, 10′ may be provided with mounting plates 36 of like curvature with the bight portions of the bucket side walls 18. Each plate member 36 is shown to overlap the leading edge portion of its bucket side wall 18. Such leading edge portion of the bucket side wall 18 is recessed at 38, immediately radially outwardly from the mounting plate 36. The scoop teeth 28 include base portions which are received within such recess 38 and are bolted or otherwise secured to the mounting plate 36. The roller cutters 26 are supported for rotation about fixed shafts 40 which are anchored at their ends to the mounting plate 36 (FIG. 6), such as by a plurality of bolts 42 which extend through the end portions of the shaft 40 into threaded openings formed in the mounting plate 36. Anti-friction bearings 44, 46 or the like are interposed between the cutter body and the non-rotating shaft 40. Plate 36 may be welded to the bucket in place of, or as a replacement for, the conventional drag teeth carrying lip. Existing buckets, may be converted by cutting off the old lip and welding a plate 36 in its place.

During forward movement of the excavator the cutting teeth on the roller cutter elements 26 are forced substantially normally into the ascending hard ground between the lower and upper levels 22, 24. The force is imposed in the wheel through its support mechanism and from the wheel to the buckets and through the buckets to the roller cutter elements 26.

Figures 4, 6:
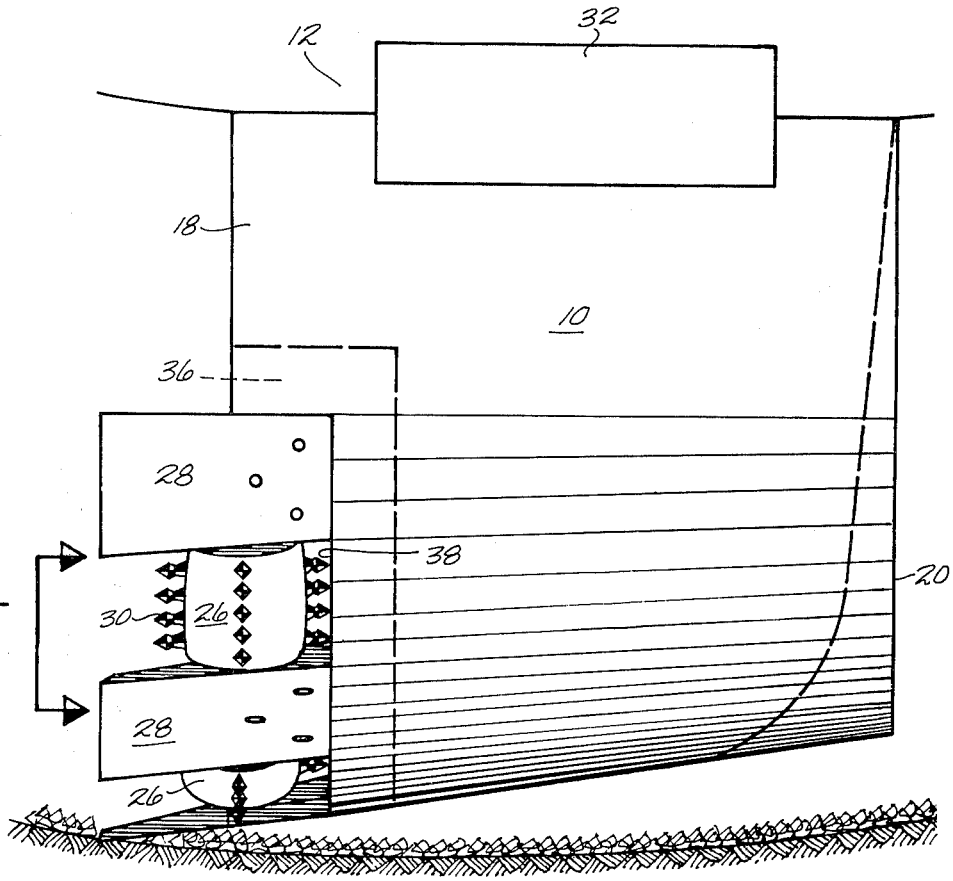
FIG. 4 is an enlarged side elevational view of the first type bucket.
FIG. 6 is a view largely in side elevation and partially in section of one of the roller cutter members and the mounting means at one end thereof.
Figure 5:
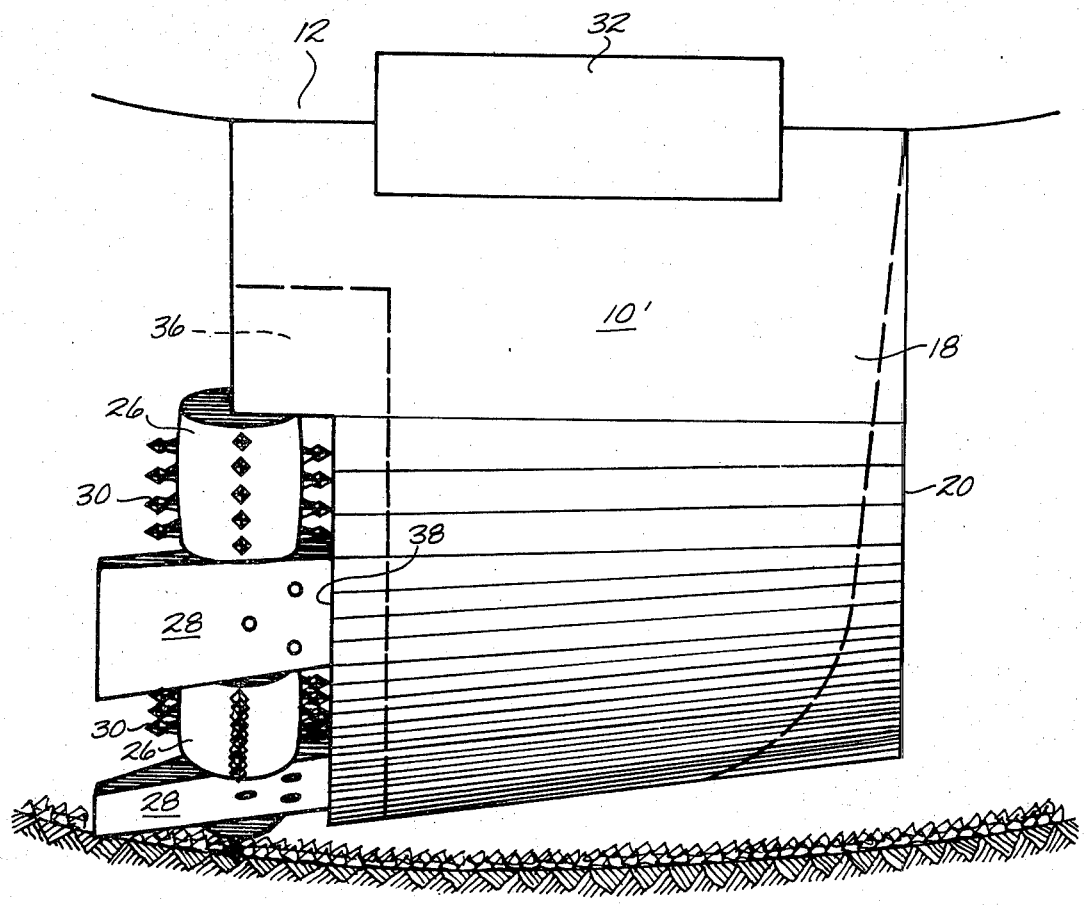
FIG. 5 is a view like FIG. 4, but of the second type of bucket.
Figure 6:
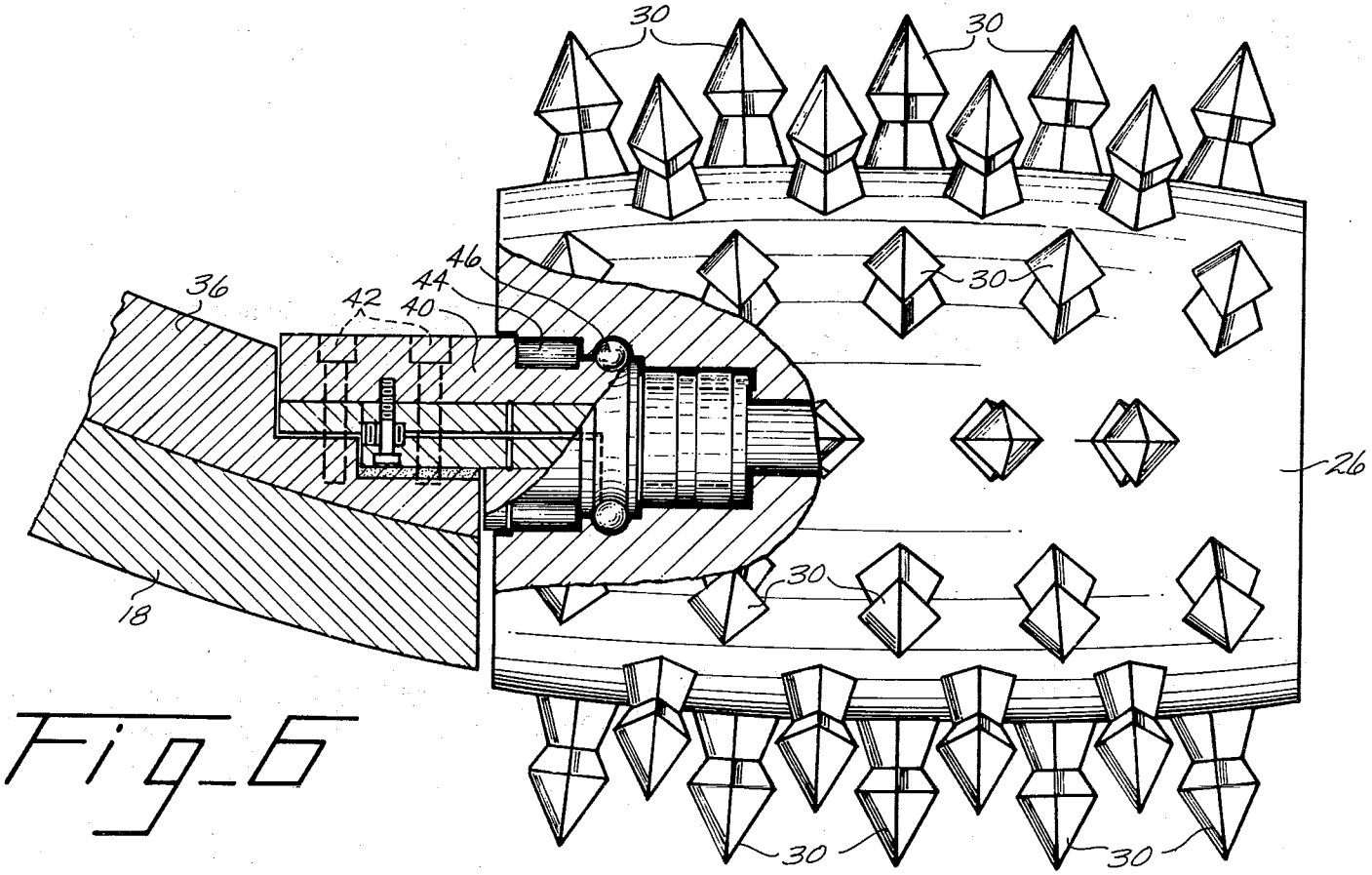

As clearly shown by FIGS. 2, 3 and 6, the buckets in the illustrated embodiment are transversely curved so that the excavator will cut a generally semi-cylindrical shaped ditch or trough. The side wall 18 of each bucket includes a curved bight portion and the ground engaging boundaries of the rollers 26 and the scoop teeth 28 substantially conform to the same curvature. In the illustrated embodiment the roller members 26 are substantially "barrel" shaped rather than exactly cylindrical.

It is believed that the excavator of the present invention is more efficient and requires less maintenance than conventional bucket excavators, such as the machines having ripper teeth on the buckets. The cutting teeth in my machine are carried by the rollers. Since such teeth are rolling as they engage the hard ground, the sheer forces are dissipated, reducing stresses on the teeth and on the roller mounts, hence lengthening the working life of such components. The cutting teeth on the rollers relieve the scoop teeth of the task of penetrating the rigid material. Thus, the life of the scoop teeth is prolonged. The cutter teeth on the rollers are forced endwise into the hard material. Then, rearward rotation of the cutter rollers moves the teeth rearwardly through material which has been broken, so that it exerts only small bending forces on the teeth.

It is believed that excavation by use of the machine of this invention will proceed at a faster rate than would be possible by use of a conventional bucket excavator. Also, the equipment of this invention will produce uniformly crushed material instead of large chunks or large rocks, such as the case with the use of most conventional excavators. As a result, the crushed material is more easily handled and in some respects is more readily usable, such as for backfill use.

Although but one specific embodiment of this invention has been herein shown and described it will be understood that numerous details of the construction shown may be altered or omitted without departing from the spirit of the invention as defined by the following claims.

What is claimed is:

1. An endless bucket type excavator comprising:

an endless chain of buckets supported for tangential entry into ground to be excavated, each said bucket having a transverse leading portion characterized by roller cutter means alternating with scoop teeth, with scoop teeth on alternate buckets following the path of roller cutter means on intermediate buckets, and with scoop teeth on intermediate buckets following the path of roller cutter means on alternate buckets, said roller cutter means comprising a plurality of radially extending teeth which penetrate into and fracture the ground material.

2. The excavator of claim 1, wherein the teeth include pointed outer end portions which taper outwardly from a relatively wide part to a point and the teeth are recessed immediately inwardly of said relatively wide part, and with the recesses of such teeth collectively providing expansion space for the ground material which is fractured by the teeth.

3. The excavator of claim 1, wherein the leading portions of the buckets are transversely arcuate in shape and the roller cutter means are longitudinally curved to conform with the curvature of the leading portions of the buckets.

4. The excavator of claim 1, including a common support means for mounting both the roller cutter means and the scoop teeth on the buckets, wherein such means comprises a mounting plate forming a part of the transverse leading portion of the bucket, a non-rotating axle for each roller cutter means, detachable connector means for detachably connecting the ends of such axles to the mounting plate, and detachable connector means for detachably connecting the scoop teeth to the mounting plate.

5. The excavator of claim 4, wherein the leading portions of the buckets are transversely arcuate in shape and the roller cutter means are longitudinally curved to conform with the curvature of the leading portions of the buckets.

6. The excavator of claim 4, wherein the teeth include pointed outer end portions which taper outwardly from a relatively wide part to a point and the teeth are recessed immediately inwardly of said relatively wide part, and with the recesses of such teeth collectively providing expansion space for the ground material which is fractured by the teeth.

7. An endless bucket type excavator comprising:

an endless chain of buckets supported for tangential entry into ground to be excavated, each said bucket having a transverse leading portion characterized by roller cutter means alternating with scoop teeth, with scoop teeth on alternate buckets following the path of roller cutter means on intermediate buckets, and with scoop teeth on intermediate buckets following the path of roller cutter means on alternate buckets, wherein the leading portions of the buckets are transversely arcuate in shape and the roller cutter means are longitudinally curved to conform with the curvature of the leading portions of the buckets.

8. An endless bucket type excavator comprising:

an endless chain of buckets supported for tangential entry into ground to be excavated and forward movement in the same direction, each said bucket having a transverse leading portion characterized by roller cutter means alternating with scoop teeth, with scoop teeth on alternate buckets following the path of roller cutter means on intermediate buckets, and with scoop teeth on intermediate buckets following the path of roller cutter means on alternate buckets, and such support means comprising a mounting plate forming a part of the transverse leading portion of the bucket, a non-rotating axle for each roller cutter means, detachable connector means for detachably connecting the ends of such axles to the mounting plate, and detachable connector means for detachably connecting the scoop teeth to the mounting plate.

* * * * *